United States Patent [19]

Wong et al.

[11] 4,091,468

[45] May 30, 1978

[54] SKIRT AND METHODS OF MAKING THE SAME

[76] Inventors: Dickson Tak Sun Wong, 71-75, Chai Wan Kok Street, Victory Factory Building, 2nd Floor, Tsuen Wan, New Territories, Lowloon; Quen Ling Liu, 679 Nathan Road, 3rd Floor, Block A, Kowloon, both of Hong Kong

[21] Appl. No.: 758,726

[22] Filed: Jan. 12, 1977

[51] Int. Cl.[2] ..... A41D 1/14

[52] U.S. Cl. ..... 2/212

[58] Field of Search ..... 2/211, 243 B, 212, 211, 2/214

[56] References Cited

U.S. PATENT DOCUMENTS

| | | | |
|---|---|---|---|
| 552,004 | 12/1895 | Royce | 2/212 |
| 2,098,810 | 11/1937 | Pierce | 2/212 |

*Primary Examiner*—Doris L. Troutman

*Attorney, Agent, or Firm*—Ladas, Parry, Von Gehr, Goldsmith & Deschamps

[57] ABSTRACT

A lower garment is made up of a front panel and a rear panel and includes an upper part extending downwardly from a waist region of the garment to a crotch region thereof, at which the front panel is secured to the rear panel. The garment also includes a lower part extending downwardly from the crotch region in the form of a skirt having a single, continuous lower boundary.

4 Claims, 3 Drawing Figures

FIG. 1
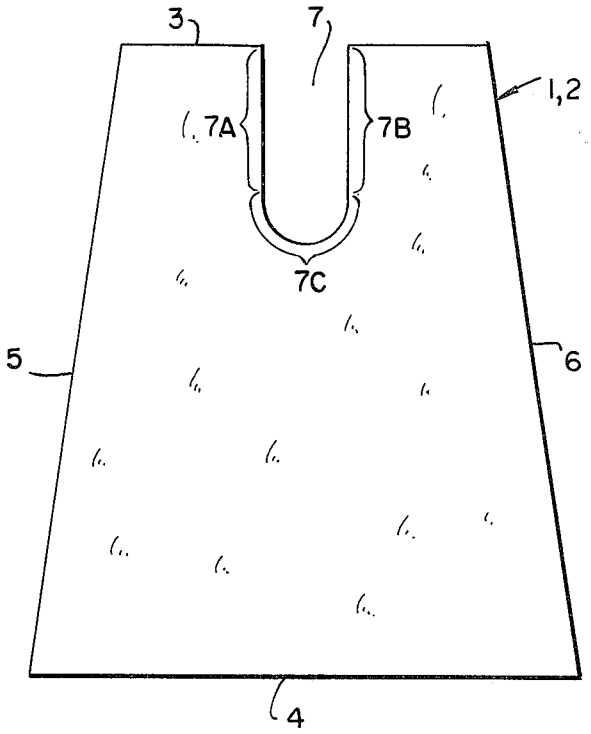
FIG. 2
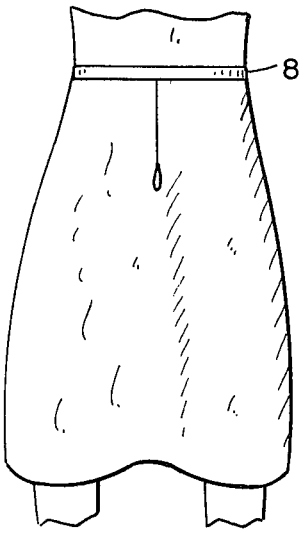
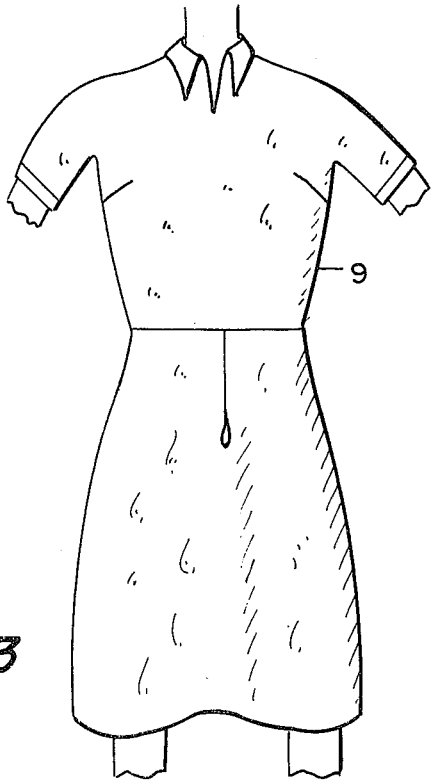
FIG. 3

SKIRT AND METHODS OF MAKING THE SAME

The invention relates to lower garments, that is garments which are used to clothe the wearer from the waist down, and methods of making the same.

Skirts and pants are widely used as women's lower garments. A skirt is generally of simple construction, having a waistband and up to four panels of generally trapezoidal shape. The shorter parallel side of each panel is sewn to the waistband and the longer parallel side of each panel forms part of the lower hem. The non-parallel sides of the panels are sewn to adjacent panels. There may be fewer than four panels, for example there may be just a rear panel and a front panel, in which case the construction is even simpler. Pants have increased in popularity as lower garments in recent years, but they suffer from the disadvantage that they are of more complex construction than a skirt and are correspondingly expensive to produce in terms of labor. Thus, a conventional pair of pants has a waistband and four panels, each of which may, for the sake of simplicity, be regarded as a narrow rectangular strip. One short edge of each strip is sewn to the waistband and the strips are sewn together in pairs to form two legs. This requires the sewing of two outside leg seams and two inside leg seams, and also two seams, at the center of the front and the center of the back respectively, which extend downwardly from the waistband and meet the inside leg seams at the crotch of the garment.

Another lower garment which has enjoyed recent popularity is the culotte or divided skirt. This is of essentially the same construction as pants but the legs, which do not extend to the wearer's feet but to the knee or mid-calf, are wider and more flared than is usual in the case of pants.

A skirt, pants or a culotte is a pure lower garment, in that it only clothes the wearer from the waist down and is used in combination with an upper garment, such as a shirt, blouse or sweater, to clothe the wearer from the waist up. Some garments such as dresses and jump-suits are integral combinations of upper and lower garments: a dress is essentially a skirt joined to a shirt or like upper garment, whereas a jump-suit is essentially pants joined to a shirt or other upper garment.

According to a first aspect of the present invention there is provided a lower garment made up of a front panel and a rear panel and comprising an upper part extending downwardly from a waist region of the garment to a crotch region thereof, at which the front panel is secured to the rear panel, and a lower part extending downwardly from said crotch region in the form of a skirt having a single, continuous lower boundary.

According to a second aspect of the present invention there is provided a method of making a lower garment, including the following steps:

(a) forming a front panel of the garment with a slot extending downwardly from the waist;

(b) forming a rear panel of the garment with a slot extending downwardly from the waist;

(c) securing together the two opposite edges of the slot in the front panel;

(d) securing together the two opposite edges of the slot in the rear panel;

(e) securing the base of the slot in the front panel to the base of the slot in the rear panel, thereby to form a crotch region; and (f) securing the two panels together at their sides; whereby a lower garment is produced having an upper part extending downwardly from the waist region to the crotch region and a lower part extending downwardly from the crotch region in the form of a skirt having a single, continuous lower boundary.

The present invention may be used to provide a lower garment which, when worn, has the appearance of pants or a culotte but is of only slightly more complex construction than a conventional skirt. The invention is not, however, restricted to pure lower garments, since the garment may be secured at its waist to a shirt or blouse — like upper garment.

For a better understanding of the invention, and to show how the same may be carried into effect, reference will now be made, by way of example, to the accompanying drawing in which:

FIG. 1 shows a plan view of one panel of a lower garment embodying the first aspect of the invention;

FIG. 2 shows an elevation of the garment when in use; and

FIG. 3 shows an elevation of another garment made using the panel shown in FIG. 1.

Each illustrated garment comprises a front panel 1 and a rear panel 2. As shown in FIG. 1, each panel is of generally trapezoidal shape, having two parallel edges 3 and 4 and two non-parallel edges 5 and 6. Each panel is formed with a generally U-shaped slot 7 extending from the center of the edge 3 towards the edge 4. The slot 7 is about 12 inches deep and about 4 inches wide in the case of a typical garment. The boundaries of the slot 7 may be conveniently regarded as divided into three sections, namely sections 7A and 7B bounding the parallel limbs of the U-shaped slot, and a section 7C bounding the curved base of the slot. In constructing the garment, the sections 7A and 7B of the front panel 1 are sewn together, and the sections 7A and 7B of the rear panel 2 are shown together. The section 7C of the front panel is then sewn to the section 7C of the rear panel. The edges 5 and 6 of the front panel are then sewn to the corresponding edges of the rear panel. The edges 4 of the front and rear panels then form the lower hem of the garment and the edges 3 are sewn to a waistband, for example, or to a shirt-like upper portion of the garment.

If the sections 7C of the panels 1 and 2 extend fully around the curved bases of the U-shaped slots 7, on opening is formed where the section 7C of the panel 1 is sewn to the section 7C of the panel 2. This opening may be avoided by sewing the two sides of each section 7C together as well as to the other section 7C, or by restricting the sections 7C to the very bases of the U-shaped slots 7 so that the sections 7A and 7B extend not only along the parallel limbs of the U-shaped slots 7 but also around the major parts of each side of the curved bases of the slots.

In order to facilitate dressing and undressing, it is nessary that one of the seams extending downwardly from the edges 3 should include a zipper or like fastening means. Thus, whereas the sections 7A and 7B of the front panel, for example, are sewn together, the upper portions at least of the sections 7A and 7B of the rear panel may be sewn to the two sides of a zip fastener. Other fastening means, for example buttons and button holes, may also be employed. The fastener may alternatively be provided at the upper portion of the seam between the edge 5 or 6 of the front panel and the corresponding edge of the rear panel.

It will be appreciated by a person skilled in the art that the construction in the region of the slot 7 results in the garment having a crotch region, like pants, yet the lower region of the garment is not divided but is more like a conventional skirt, and accordingly there are no inside leg seams. However, the fact that the garment has a crotch portion results in its having the appearance, when in use, of pants or a culotte, depending on how widely the edges 5 and 6 of the panels are flared: the more extreme the flare, the more closely does the appearance of the garment approach that of a skirt.

The cutting of the pieces required for the garment is much simpler than in the case of pants, and so is the subsequent sewing together of the pieces. Thus, the garment is considerably less expensive to produce in terms of labor costs than are conventional pants.

The garment may be a pure lower garment as shown in FIG. 2, in which case the edges 3 are secured to a waistband 8, or the lower garment may be intergrally combined with an upper garment 9 to form a dresslike garment, as shown in FIG. 3.

It is to be understood that the invention is not limited to the specific method and construction shown and described, since it will be apparent to those skilled in the art that changes may be made without departing from the principles of the invention as defined in the appended claims. For example, the section 7C of the panel 1 may be sewn to the section 7C of the panel 2 before the sections 7A and 7B of the panel 1 are sewn together and the section 7A and 7B of the panel 2 are sewn together. Also, the edges 5 and 6 of the front panel may be sewn to the corresponding edges of the rear panel before the sections 7A, 7B and 7C are operated upon. It is necessary only that the described steps should be performed, and the order in which they are performed is not critical.

We claim:

1. A lower garment made up of a front panel and a rear panel and comprising an upper part extending downwardly from a waist region of the garment to a crotch region thereof, at which the front panel is secured to the rear panel, whereby said upper part is constructed as a pant, and a lower part extending downwardly from said crotch region in the form of a skirt having a single, continuous lower boundary.

2. A garment as claimed in claim 1, wherein said upper part is provided at its upper boundary with a waistband.

3. A garment as claimed in claim 1, in integral combination with an upper garment secured to the lower garment at the upper boundary of said upper part.

4. A method of making a lower garment, including the following steps:

(a) forming a front panel of the garment with a slot extending downwardly from the waist;
(b) forming a rear panel of the garment with a slot extending downwardly from the waist;
(c) securing together the two opposite edges of the slot in the front panel;
(d) securing together the two opposite edges of the slot in the rear panel;
(e) securing the base of the slot in the front panel to the base of the slot in the rear panel, thereby to form a crotch region; and
(f) securing the two panels together at their sides; whereby a lower garment is produced having an upper part constructed as a pant and extending downwardly from the waist region to the crotch region and a lower part extending downwardly from the crotch region in the form of a skirt having a single, continuous lower boundary.

* * * * *